US010875327B2

(12) United States Patent
Inoue et al.

(10) Patent No.: US 10,875,327 B2
(45) Date of Patent: Dec. 29, 2020

(54) PRINTER AND CUTTER DEVICE OF PRINTER

(71) Applicant: SEIKO EPSON CORPORATION, Tokyo (JP)

(72) Inventors: Nobuhiro Inoue, Matsumoto (JP); Tetsugo Ishida, Yamagata-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/567,772

(22) Filed: Sep. 11, 2019

(65) Prior Publication Data

US 2020/0079121 A1 Mar. 12, 2020

(30) Foreign Application Priority Data

Sep. 11, 2018 (JP) ..... 2018-169416

(51) Int. Cl.

| | |
|---|---|
| ***B41J 11/70*** | (2006.01) |
| ***B26D 5/08*** | (2006.01) |
| ***B26D 1/08*** | (2006.01) |
| ***B26D 1/18*** | (2006.01) |
| ***B26D 1/38*** | (2006.01) |
| ***B41J 15/04*** | (2006.01) |
| ***B65H 35/04*** | (2006.01) |

(52) U.S. Cl.

CPC ..... *B41J 11/70* (2013.01); *B26D 1/085* (2013.01); *B26D 1/185* (2013.01); *B26D 1/385* (2013.01); *B26D 5/08* (2013.01); *B41J 11/706* (2013.01); *B41J 15/042* (2013.01); *B65H 35/04* (2013.01); *Y10T 83/7763* (2015.04)

(58) Field of Classification Search

CPC ..... B41J 11/70; B41J 11/706; B41J 15/042; B26D 1/085; B26D 1/185; B26D 1/385; B26D 5/08; B65H 35/04; Y10T 83/7763

See application file for complete search history.

(56) References Cited

U.S. PATENT DOCUMENTS

| | | | | |
|---|---|---|---|---|
| 6,848,847 | B2 * | 2/2005 | Murakoshi | B41J 11/24 400/611 |
| 6,899,479 | B2 * | 5/2005 | Hayashi | B26D 1/385 400/605 |
| 8,469,616 | B2 * | 6/2013 | Kawaguchi | B26D 1/085 400/621 |
| 9,487,036 | B2 | 11/2016 | Ishida | |
| 9,731,523 | B2 | 8/2017 | Ishida | |
| 2002/0056354 | A1 * | 5/2002 | Morita | B26D 1/085 83/564 |

(Continued)

FOREIGN PATENT DOCUMENTS

| | | |
|---|---|---|
| CN | 105730031 | 7/2016 |
| JP | 2005-161481 | 6/2005 |

*Primary Examiner* — Anh T Vo

(74) *Attorney, Agent, or Firm* — Workman Nydegger

(57) ABSTRACT

A printer includes a first blade configured to be movable between a standby position and a cutting position, a second blade configured to contact the first blade located in the cutting position, a drive mechanism configured to drive the first blade, and a first elastic member configured to pull the first blade located in the cutting position. When the first blade is located in the cutting position, the first elastic member pulls the first blade in a direction in which the first blade moves to the standby position, and pulls the first blade in a direction in which the first blade approaches the second blade.

8 Claims, 8 Drawing Sheets

(56) References Cited

U.S. PATENT DOCUMENTS

| | | | | |
|---|---|---|---|---|
| 2011/0048198 | A1* | 3/2011 | Watanabe | B41J 11/706<br>83/72 |
| 2016/0185140 | A1 | 6/2016 | Ishida | |
| 2017/0021646 | A1 | 1/2017 | Ishida | |
| 2020/0079120 | A1* | 3/2020 | Kinoshita | B26D 1/085 |

* cited by examiner

PRINTER AND CUTTER DEVICE OF PRINTER

The present application is based on, and claims priority from JP Application Serial Number 2018-169416, filed Sep. 11, 2018, the disclosure of which is hereby incorporated by reference herein in its entirety.

BACKGROUND

1. Technical Field

The present disclosure relates to a printer and a cutter device of the printer.

2. Related Art

A printer on which a cutter device is installed is described in JP-A-2005-161481. The cutter device of JP-A-2005-161481 is a so-called cutter device in which two blades intersect each other, and is configured such that a movable blade reciprocates linearly under driving force from a drive motor. When the movable blade moves from an open position with respect to a fixed blade, and crosses the fixed blade, the movable blade cuts a sheet inserted between the movable blade and the fixed blade. After the cutting operation, the movable blade transitions into a return operation and moves again to the open position. Further, the cutter device of JP-A-2005-161481 includes a biasing means for providing biasing force to the movable blade by a coil spring and the like in a direction in which the sheet is cut to be able to easily cut even a sheet made of a material that is thick and difficult to cut, and also accumulating the biasing force in the coil spring with the return operation of the movable blade.

However, since the cutter device described in JP-A-2005-161481 is provided with the coil spring that provides the biasing force to the movable blade in the direction in which the sheet is cut, there is a risk that, after the cutting operation, the movable blade transitions into the return operation and the movement back to the open position is delayed.

SUMMARY

A printer according to an exemplary embodiment of the present disclosure includes a first blade configured to be movable between a standby position and a cutting position, a second blade configured to contact the first blade located in the cutting position, a drive mechanism configured to drive the first blade, and a first elastic member configured to pull the first blade located in the cutting position. When the first blade is located in the cutting position, the first elastic member pulls the first blade in a direction in which the first blade moves to the standby position, and pulls the first blade in a direction in which the first blade approaches the second blade.

In the printer according to an exemplary embodiment, the drive mechanism may further include an engagement portion, the first blade may move from the standby position to the cutting position by engaging with the engagement portion, and when the first blade is disengaged from the engagement portion after moving to the cutting position, the first blade may move from the cutting position to the standby position.

In the printer according to an exemplary embodiment, the first elastic member may be a tension spring that is hung on a hook portion provided at a center, in a width direction, of the movable blade.

In the printer according to an exemplary embodiment, the hook portion may include a resin member.

In the printer according to an exemplary embodiment, a spring length of the tension spring may be maximum when the first blade is located in the cutting position.

The printer according to an exemplary embodiment may further include a second elastic member configured to pull the first blade in a direction in which the first blade moves to the cutting position when the first blade is located in the standby position.

The printer according to an exemplary embodiment may further include a device main body including a printing mechanism portion and a sheet holding portion configured to hold a sheet, and a lid portion pivotally provided on the device main body to cover the sheet, and the second blade may be provided closer to the sheet holding portion side than the first blade is.

DESCRIPTION OF EXEMPLARY EMBODIMENTS

The exemplary embodiment will be described below. Note that the exemplary embodiment described hereinafter is not intended to unjustly limit the content of the present disclosure as set forth in the claims. In addition, all of the configurations described in the exemplary embodiment are not necessarily essential constituent requirements of the present disclosure.

Overall Configuration of Printer

First, a printer 1 according to the exemplary embodiment will be described with reference to FIGS. 1 and 2.

Figure 1:
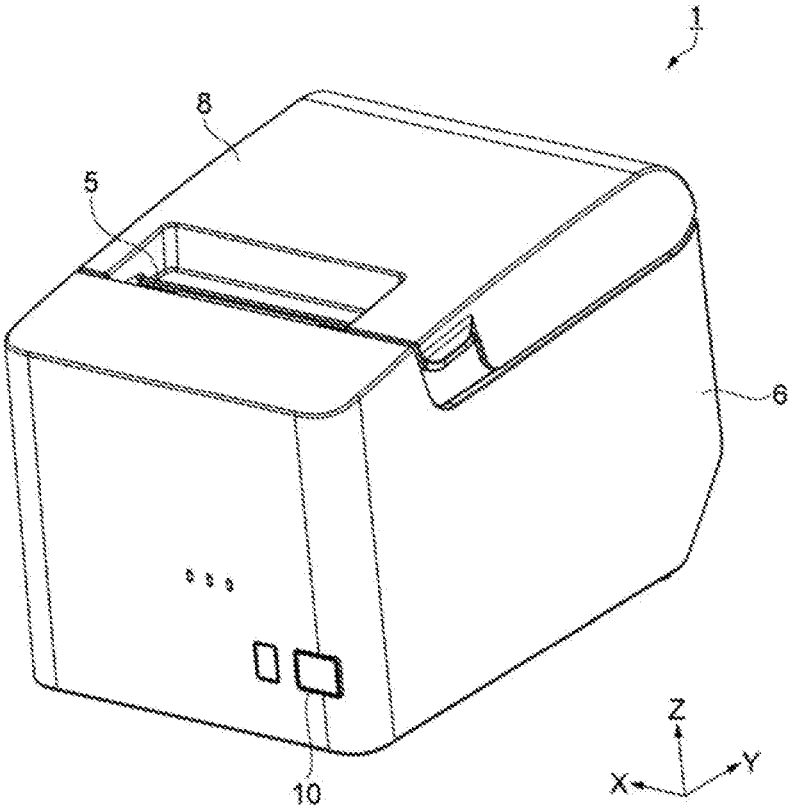
FIG. 1 is a perspective view illustrating a printer according to the exemplary embodiment.

FIG. 1 is a perspective view illustrating the printer according to the exemplary embodiment. FIG. 2 is a cross-sectional side view illustrating an overview of the printer. Note that, for the sake of convenience of description, an X-axis, a Y-axis, and a Z-axis are illustrated in the following diagrams as three axes perpendicular to each other. Further, hereinafter, a direction parallel to the X-axis, a direction parallel to the Y axis, and a direction parallel to the Z-axis are also referred to as an "X-axis direction", a "Y-axis direction", and a "Z-axis direction", respectively. The X-axis direction is also referred to as a "width direction". A +Y-axis direction is also referred to as "rear" or a "cutting direction". A −Y-axis direction is also referred to as "front" or a "retracting direction". A +Z-axis direction is also referred to as "above". A −Z-axis direction is also referred to as "below" or an "engaging direction".

As illustrated in FIG. 1, the printer 1 includes a device main body 6 having a box shape, and a lid portion 8 serving as a pivotable opening and closing door that covers the device main body 6 from above.

The device main body 6 is provided with a sheet holding portion 7 (see FIG. 2) that houses a sheet 2 such as roll paper inside the sheet holding portion 7, and an electrical power switch 10 in front of the device main body 6. The lid portion 8 covers the sheet 2 of the sheet holding portion 7 from above and is provided at the rear of a discharge port 5.

Figure 2:
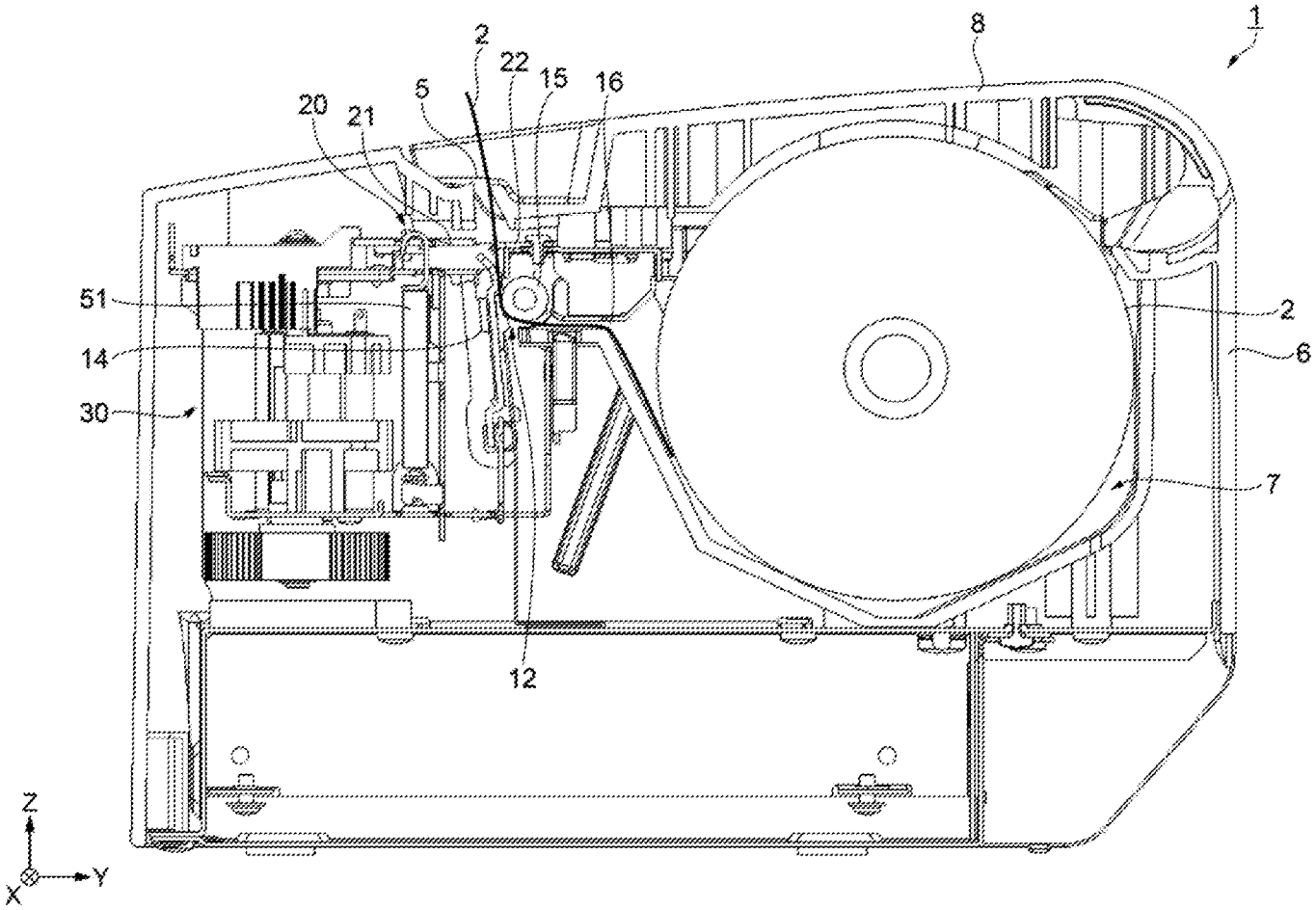
FIG. 2 is a cross-sectional side view illustrating an overview of the printer.

As illustrated in FIG. 2, a printing mechanism portion 12 and a cutter device 20 are mounted inside the device main body 6. Further, a transport path 16 of the sheet 2 is provided inside the device main body 6 from the sheet holding portion 7 to the discharge port 5 via the printing mechanism portion 12 and the cutter device 20.

A print head 14 is a thermal head. A printing position is defined by a platen roller 15 that faces the print head 14. A rotational drive force of a transport motor (not illustrated) is transmitted to the platen roller 15. The platen roller 15 and the transport motor constitute a transport mechanism that transports the sheet 2 along the transport path 16.

The printer 1 drives the transport motor, and transports the sheet 2 set along the transport path 16 by the platen roller 15. Further, the printer 1 drives the print head 14, and performs printing on the sheet 2 transported to the printing position. Furthermore, the printer 1 drives the cutter device 20, and cuts the sheet 2.

Note that a fixed blade 22 (second blade) of the cutter device 20 is disposed closer to the sheet holding portion 7 side than a movable blade 21 (first blade). Thus, the transport path 16 of the sheet 2 can be provided between a drive unit 30 that drives the movable blade 21 and the sheet holding portion 7, which makes it possible to reduce the size of the printer 1.

Configuration of Cutter Device

Next, a configuration of the cutter device 20 will be described with reference to FIGS. 3A to 7.

Figure 3A:
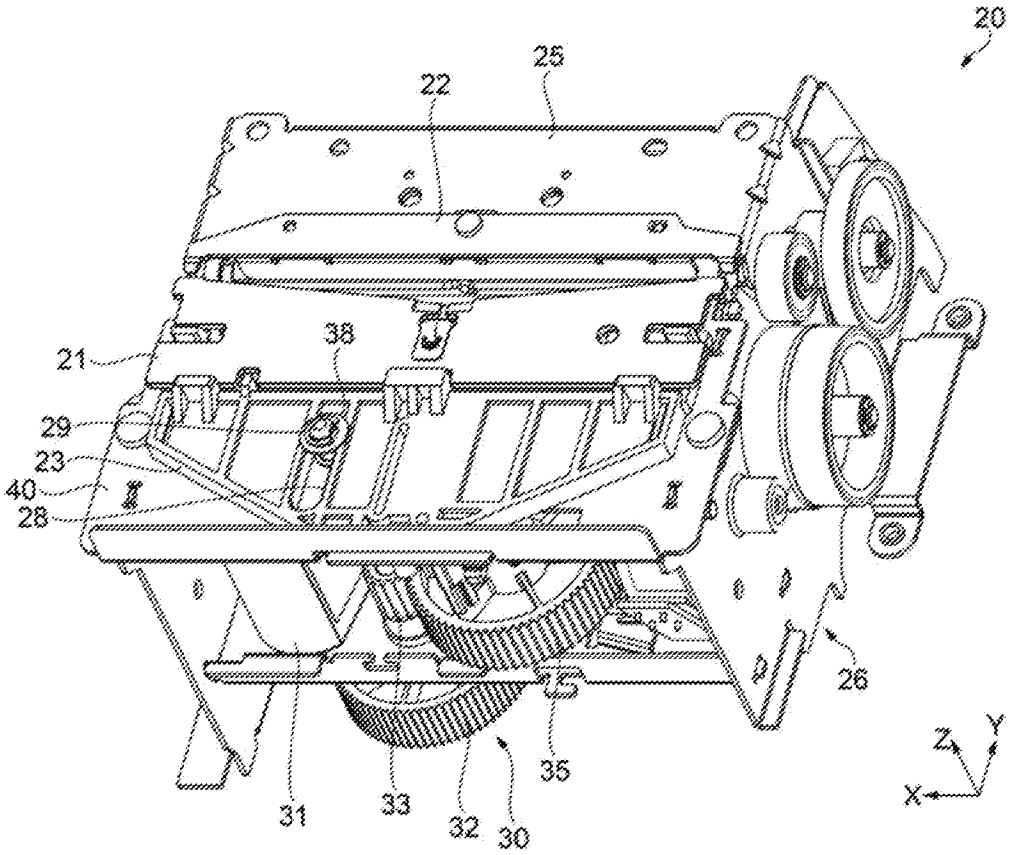
FIG. 3A is a perspective view illustrating an overview of a cutter device (with a movable blade on standby).
Figure 3B:
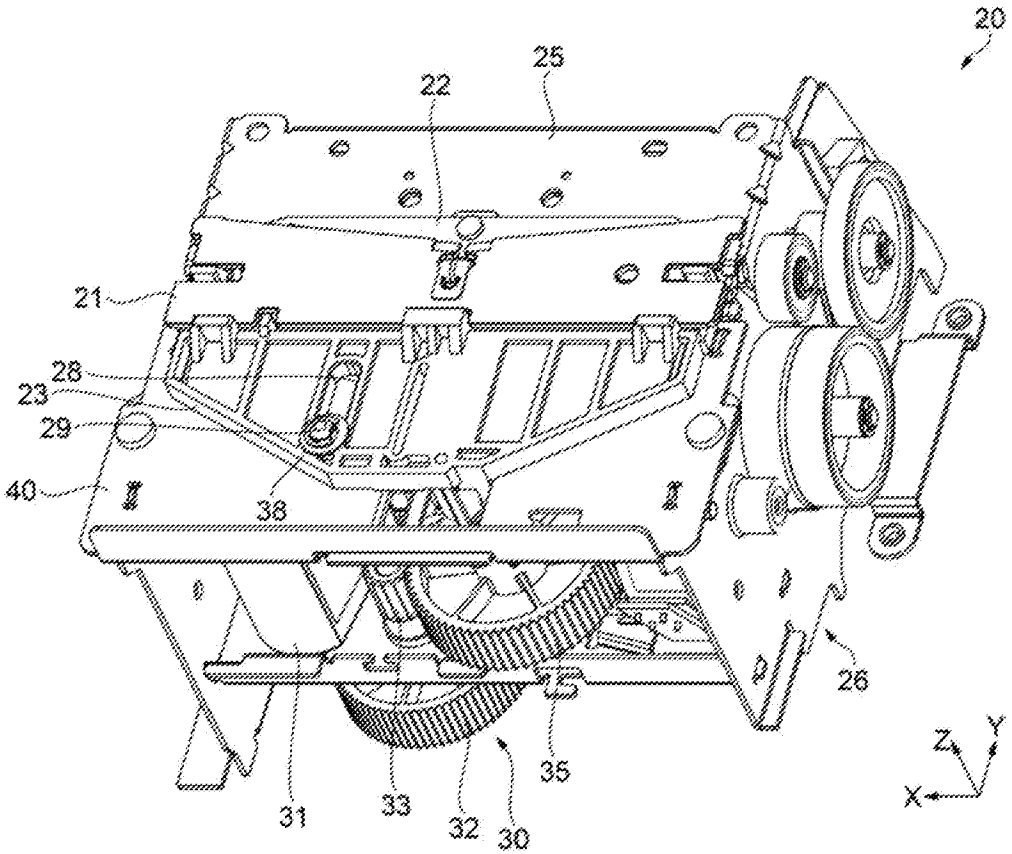
FIG. 3B is a perspective view illustrating an overview of the cutter device (with the movable blade at a full stroke).
Figure 4A:
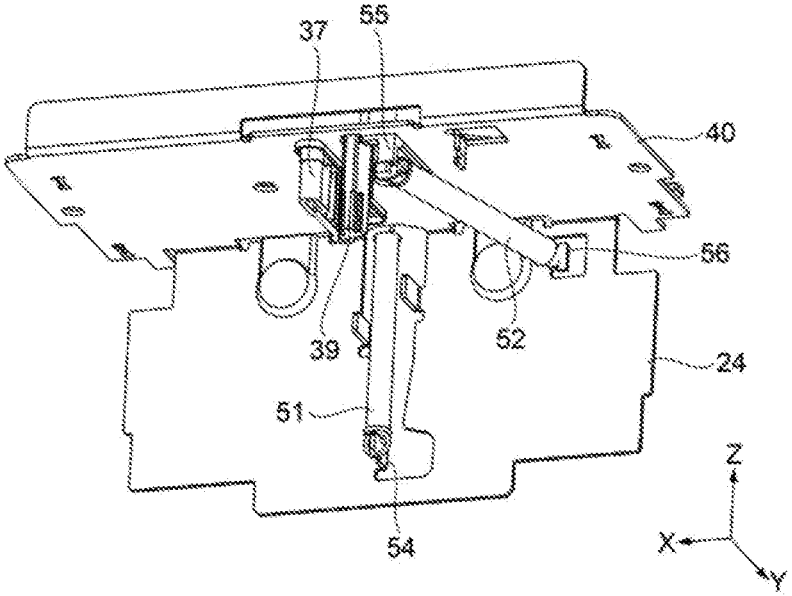
FIG. 4A is a perspective view illustrating a mechanism of the movable blade (with the movable blade on standby).
Figure 4B:
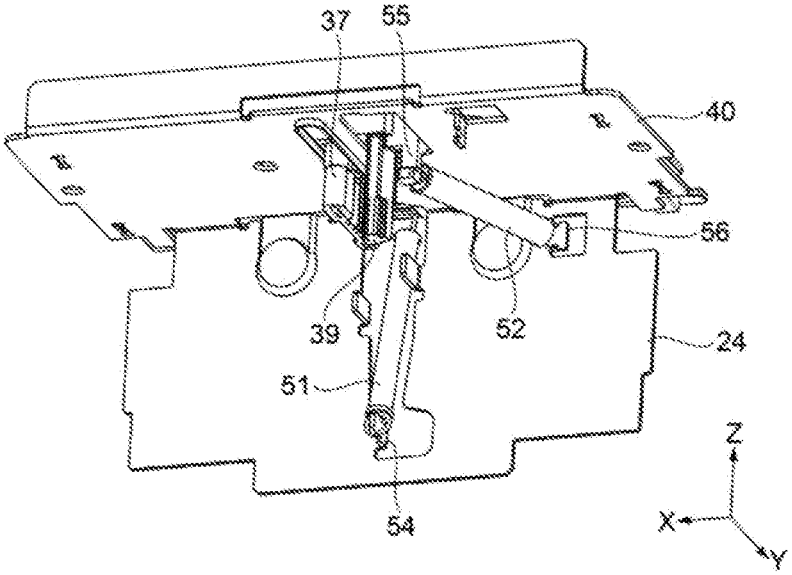
FIG. 4B is a perspective view illustrating the mechanism of the movable blade (with the movable blade at a full stroke).
Figure 5A:
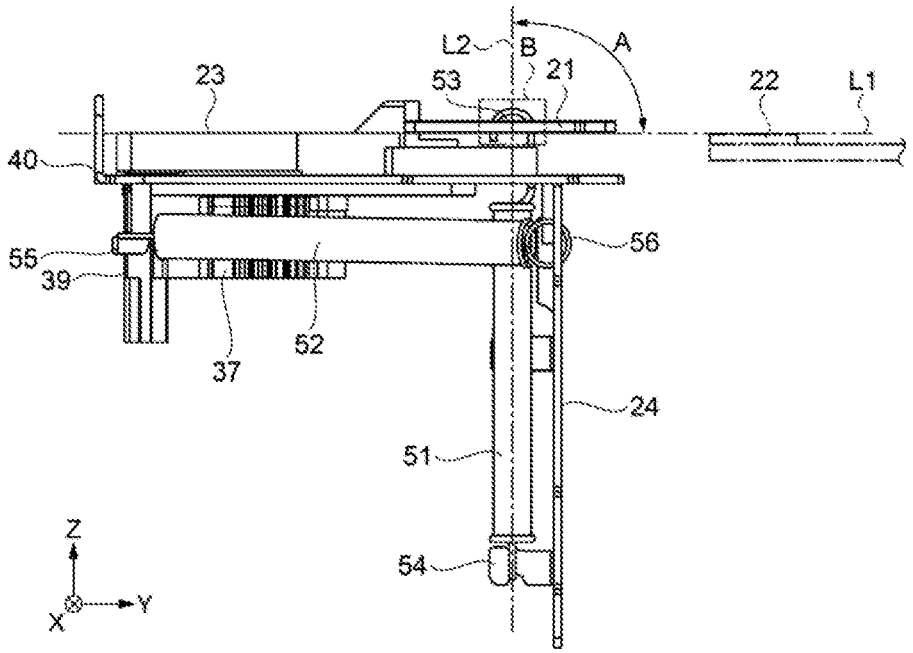
FIG. 5A is a side view illustrating the mechanism of the movable blade (with the movable blade on standby).
Figure 5B:
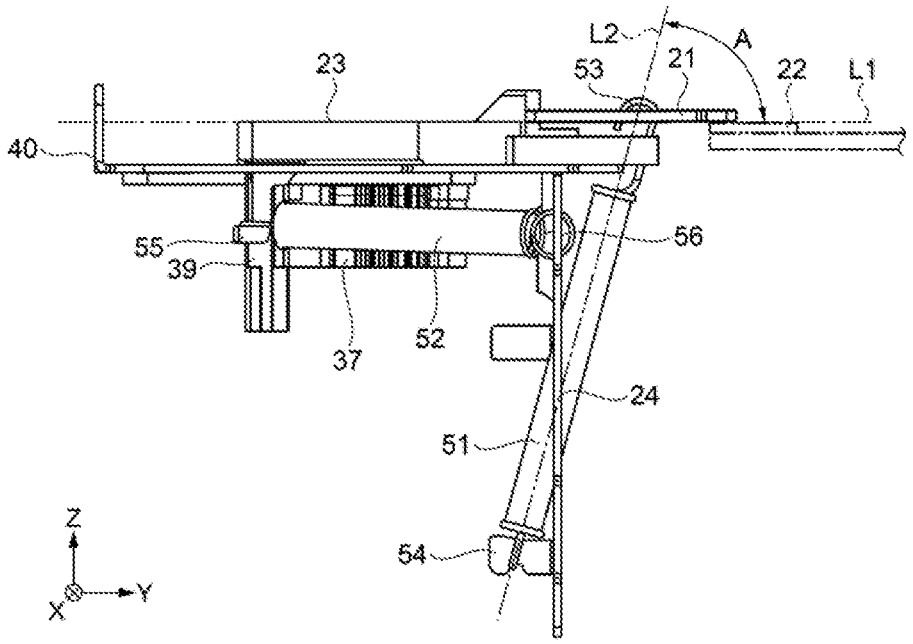
FIG. 5B is a side view illustrating the mechanism of the movable blade (with the movable blade at a full stroke).
Figure 6A:
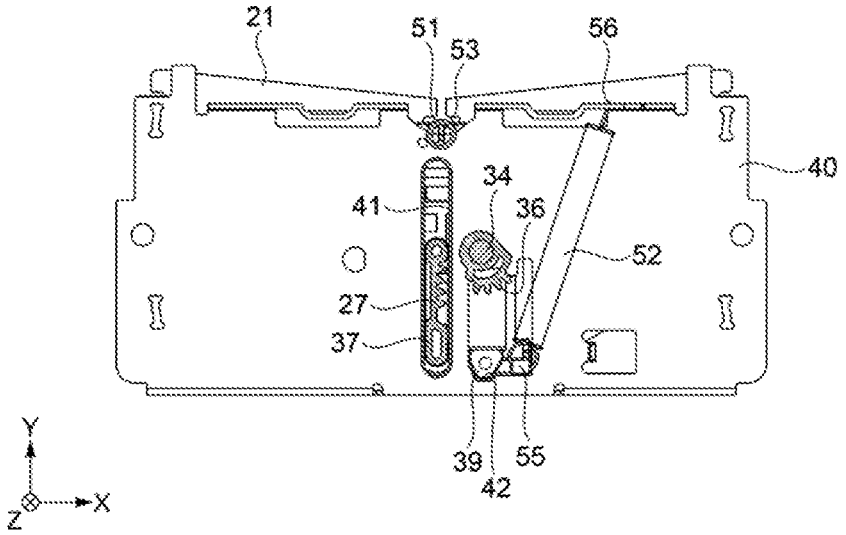
FIG. 6A is a plan view illustrating the mechanism of the movable blade (with the movable blade on standby).
Figure 6B:
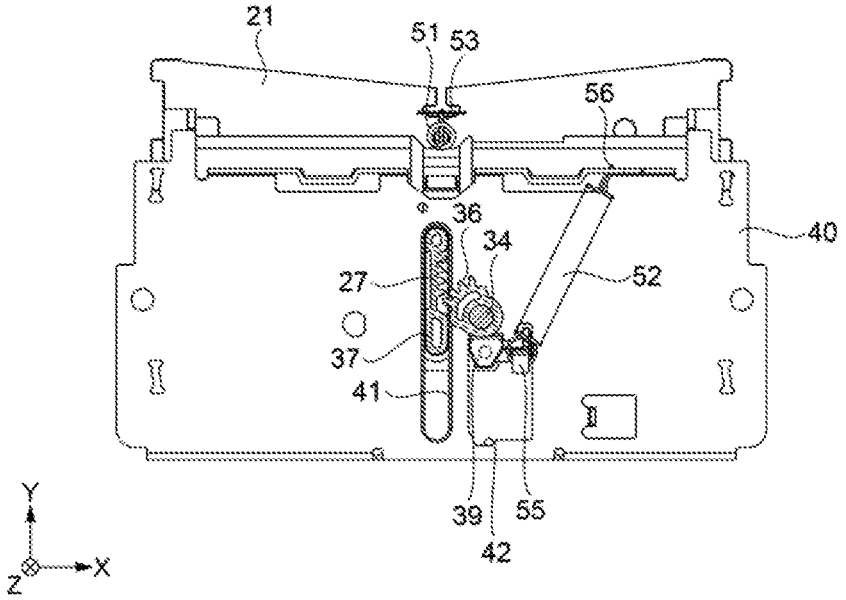
FIG. 6B is a plan view illustrating the mechanism of the movable blade (with the movable blade at a full stroke).
Figure 7:
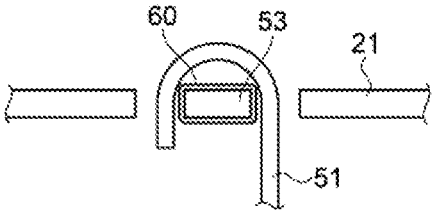
FIG. 7 is an enlarged cross-sectional view of a B portion in FIG. 5A.

FIGS. 3A and 3B are perspective views illustrating an overview of the cutter device. FIG. 3A illustrates the movable blade on standby, and FIG. 3B illustrates the movable blade at a full stroke. FIGS. 4A and 4B are perspective views illustrating a mechanism of the movable blade. FIG. 4A illustrates the movable blade on standby, and FIG. 4B illustrates the movable blade at a full stroke. FIGS. 5A and 5B are side views illustrating the mechanism of the movable blade. FIG. 5A illustrates the movable blade on standby, and FIG. 5B illustrates the movable blade at a full stroke. FIGS. 6A and 6B are plan views illustrating the mechanism of the movable blade. FIG. 6A illustrates the movable blade on standby, and FIG. 6B illustrates the movable blade at a full stroke. FIG. 7 is an enlarged cross-sectional view of a B portion in FIG. 5A.

As illustrated in FIGS. 3A and 3B, the cutter device 20 includes the movable blade 21, the fixed blade 22, a movable blade holder 23 that holds the movable blade 21, a cover frame 25 that holds the fixed blade 22, and the drive unit 30 that causes the movable blade 21 to reciprocate in the Y-axis direction.

The movable blade 21 is formed in a so-called V-shape with a cutting edge at both ends closer to the fixed blade 22 than the cutting edge at a central portion, and is held by the movable blade holder 23. Note that the movable blade holder 23 is disposed on an upper plate 40. Further, as illustrated in FIGS. 6A and 6B, a guide hole 41 extending in the Y-axis direction is provided in the upper plate 40, and the guide hole 41 engages with a guide protrusion 37 integrally formed with the movable blade holder 23. Due to the engagement between the guide hole 41 and the guiding protrusion 37, only the movable blade holder 23 is caused to reciprocate in the Y-axis direction, and a movement direction of the movable blade 21 is regulated in the Y-axis direction.

Further, as illustrated in FIGS. 3A and 3B, a guide hole 28 extending in the Y-axis direction is provided in the movable blade holder 23, and a Z-direction regulating protrusion 29 provided in the device main body 26 protrudes from the guide hole 28. The movement in the Z-axis direction of the movable blade holder 23 is regulated by sandwiching the movable blade holder 23 between a Z-direction restricting member 38 provided on the Z-direction regulating protrusion 29 and the upper plate 40.

The fixed blade 22 is held by the cover frame 25 and is fixed to the lid portion 8. Further, a blade surface of the fixed blade 22 and a blade surface of the movable blade 21 are disposed horizontally, and the sheet 2 sandwiched between the fixed blade 22 and the movable blade 21 can be cut by moving the movable blade 21 in a cutting direction being a direction in which the movable blade 21 approaches the fixed blade 22.

In addition to a first biasing member 51 (first elastic member) described below, the drive unit 30 being a drive means (drive mechanism) configured to cause the movable blade 21 to reciprocate includes a drive motor 31, a large diameter gear portion 32, a small diameter gear portion 33, a large diameter gear portion 35, and an intermittent gear portion 36. Note that the intermittent gear portion 36 as an engagement portion can drives the movable blade 21 in the cutting direction against biasing force of the first biasing member 51.

The large diameter gear portion 32 rotates under the rotational driving force from the drive motor 31, and transmits the rotational driving force from the drive motor 31 to the large diameter gear portion 35 via the small diameter gear portion 33 having the same support shaft.

When the large diameter gear portion 35 rotates, the intermittent gear portion 36 provided on a support shaft 34 (see FIGS. 6A and 6B) also rotates.

The intermittent gear portion 36 includes a plurality of toothed gears protruding toward one direction side. As a result of the rotation of the intermittent gear portion 36, the toothed gear of the intermittent gear portion 36 engages with a recessed portion formed at the intermittent gear portion 36 side of an intermittent tooth portion 27 provided on the guide protrusion 37 formed integrally with the movable blade holder 23. The movable blade 21, together with the movable blade holder 23, move in the cutting direction along the guide hole 41. An engaging position between the tooth gear of the intermittent gear portion 36 and the recessed portion of the intermittent tooth portion 27 and positions of the guide hole 41 and the guide protrusion 37 guided by the guide hole 41 have a minimum sliding load due to prying of the guide hole 41 and the guide protrusion 37 when unbalance of a sheet cut load occurs in two sheet cutting positions, and are thus desirably provided at the center, in the width direction, of the movable blade 21, which is the center of the two sheet cutting positions.

Subsequently, when the movable blade 21 overlaps or contacts the fixed blade 22 and reaches a full stroke position (see FIGS. 3B, 4B, 5B, and 6B) as a final position (cutting position) being a position where the movable blade 21 finishes cutting the sheet 2, the engagement between the toothed gear of the intermittent gear portion 36 and the recessed portion of the intermittent tooth portion 27 is released. The movable blade 21 moves in the retracting direction being a direction in which the movable blade 21 moves away from the fixed blade 22, and stops in a standby position (see FIGS. 3A, 4A, 5A, and 6A) being a position that does not overlap or contact the fixed blade 22.

At this time, in the standby position, the standby position in the Y direction is regulated to be within a certain range by a standby position regulating protrusion 39 integrally formed with the movable blade holder 23 such that the engagement position between the intermittent gear portion 36 and the recessed portion of the intermittent tooth portion 27 does not shift during a next operation. The front side is regulated by contact between a standby position regulating protrusion-front regulating hole 42 provided in the upper plate 40 and the front of the standby position regulating protrusion 39. Further, the rear side is regulated by contact between a cam (not illustrated) integrally formed with the intermittent gear portion 36 and the rear of the standby position regulating protrusion 39. In order to stabilize the standby position, the guide protrusion 37 and the standby position regulating protrusion 39 are desirably formed integrally with the movable blade holder 23.

Furthermore, when the intermittent gear portion 36 then rotates, and the engagement between the tooth gear of the intermittent gear portion 36 and the recessed portion of the intermittent tooth portion 27 begins, the movable blade 21 moves again in the cutting direction. In this way, by rotating the intermittent gear portion 36, and repeatedly engaging and disengaging the tooth gear of the intermittent gear portion 36 and the recessed portion of the intermittent tooth portion 27, the drive unit 30 can cause the movable blade 21 to reciprocate in the cutting direction and the retracting direction.

Note that two biasing members 51 and 52 are provided in the cutter device 20 of the exemplary embodiment.

The first biasing member 51 is a tension spring, and is provided between the movable blade 21 and a support frame 24 that constitutes the device main body 26. Specifically, a first end of the first biasing member 51 is hung on a hook portion 53 provided at the center in the width direction of the movable blade 21, and a second end of the first biasing member 51 is also hung on a hook portion 54 provided below the support frame 24. Thus, the first biasing member 51 is attached to the device main body 26. Since the first biasing member 51 is hung on the hook portion 53 provided at the center in the width direction of the movable blade 21, biasing force can be stably applied to the center of the movable blade 21. The first biasing member 51 biases (pulls) the movable blade 21 in the retracting direction when the movable blade 21 moves in the cutting direction (cutting position), and the first biasing member 51 constantly biases (pulls) the movable blade 21 in the engaging direction being the −Z-axis direction. Note that the engaging direction is a direction in which the movable blade 21 is pressed against the fixed blade 22 in a direction perpendicular to the blade surface of the movable blade 21.

The drive unit 30, and the first biasing member 51 constituting the drive means described above, in cutting the sheet 2 by causing the movable blade 21 to reciprocate, are configured to end cutting, and a spring length of the first biasing member 51 is maximum in a full stroke position. Thus, when the movable blade 21 moves in the cutting direction by rotating the intermittent gear portion 36 of the drive unit 30, the biasing force acts in the retracting direction as the first biasing member 51 is pulled in the cutting direction, and the maximum biasing force is achieved in the full stroke position. Therefore, by providing the first biasing member 51, the sheet 2 is cut by the biasing force of the first biasing member 51 in the retracting direction, and after the engagement between the intermittent gear portion 36 and the intermittent tooth portion 27 is released, the movable blade 21 can be moved in the retracting direction, and the movable blade 21 can be quickly returned to the standby position.

Note that, provided that an angle at which a biasing direction L2 in which the biasing force of the first biasing member 51 acts and a retracting direction L1 of the movable blade 21 intersect each other is an angle A, as illustrated in FIG. 5B, the angle A is in a range of greater than or equal to 10° and less than or equal to 80° in a position where the movable blade 21 contacts the fixed blade 22. The biasing force in the retracting direction and the biasing force in the engaging direction can be applied to the movable blade 21, and thus the movable blade 21 can be quickly returned to the standby position. The pressing force between the movable blade 21 and the fixed blade 22 can be increased when the sheet 2 is cut, and the sheet 2 can be cut stably.

Here, when the angle A is less than 10°, the pressing force between the movable blade 21 and the fixed blade 22 becomes small, and the sheet 2 cannot be cut stably. Also, since the first biasing member 51 needs to be disposed substantially horizontally, a hole portion, in which the first biasing member 51 can be disposed, needs to be provided in the movable blade holder 23, and there is a risk that strength of the movable blade holder 23 decreases. When the angle A is greater than 80°, the biasing force in the retracting direction of the movable blade 21 is reduced, and the movable blade 21 cannot be quickly returned to the standby position.

Further, in a position where the movable blade 21 does not contact the fixed blade 22, as illustrated in FIG. 5A, the angle A is in a range of greater than or equal to 60° and less than or equal to 100°, and an attachment space of the first biasing member 51 can be reduced. In particular, the attachment space in the Y-axis direction can be shortened. When the angle A is less than 60° or greater than 100°, the first biasing member 51 needs to be attached at an inclination. Thus, the attachment space in the Y-axis direction increases, and there is a risk that the cutter device 20 increases in size.

The second biasing member 52 (second elastic member) is a tension spring, is provided between the movable blade holder 23 and the support frame 24, and is disposed parallel to the blade surface of the movable blade 21. Specifically, a first end of the second biasing member 52 is hung on a hook portion 55 provided in the retracting direction being the −Y-axis direction of the movable blade holder 23, and a second end of the second biasing member 52 is also hung on a hook portion 56 provided above the support frame 24. Thus, the second biasing member 52 is attached to the device main body 26. Further, as illustrated in FIGS. 5A, 5B, 6A, and 6B, the second biasing member 52 is disposed to provide biasing force in a direction that cancels the biasing force of the first biasing member 51, which is the so-called cutting direction opposite to the retracting direction, and constantly biases (pulls) the movable blade 21 in the cutting direction. Further, the second biasing member 52 is disposed parallel to the blade surface of the movable blade 21, and is disposed obliquely with respect to the cutting direction. The second biasing member 52 constantly biases the movable blade 21 in the cutting direction.

Note that the second biasing member 52 is disposed in the direction that cancels the biasing force of the first biasing member 51 that biases the movable blade 21 in the retracting direction, and thus, after cutting, the engagement between the intermittent gear portion 36 and the intermittent tooth portion 27 provided in the movable blade holder 23 that holds the movable blade 21 is released. When the movable blade 21 retracts in the retracting direction by the biasing force of the first biasing member 51, the biasing force that biases the movable blade 21 in the retracting direction is weakened. Thus, a striking sound generated by the movable blade holder 23 colliding with a housing (not illustrated) of the cutter device 20 can be reduced.

Further, since the second biasing member 52 is hung on the movable blade holder 23 as a holder that holds the movable blade 21, damage to the movable blade 21 can be prevented.

In addition, the second biasing member 52 is disposed parallel to the blade surface of the movable blade 21, and thus the biasing force when the movable blade 21 retracts in the retracting direction horizontal to the blade surface can be suitably weakened.

Also, the second biasing member 52 is disposed obliquely with respect to the cutting direction, and thus unsteadiness of the movable blade holder 23 that holds the movable blade 21 can be moved in one direction and the operation during cutting can be stabilized.

Note that, as illustrated in FIG. 7, a resin member 60 is provided on the hook portion 53 of the movable blade 21 on which the first biasing member 51 is hung. Thus, wear of the hook portion 53 and the first biasing member 51 can be reduced.

A constituent material of the resin member 60 may be any of urethane resin, polyethylene, polyurethane, and polyvinyl chloride, for example. Further, in the present exemplary embodiment, the resin member 60 is provided on the hook portion 53, but the resin member 60 may also be similarly provided on the other hook portions 54, 55, and 56.

As described above, the cutter device 20 in the present exemplary embodiment includes the first biasing member 51 having biasing force that biases the movable blade 21 in the retracting direction. Thus, the sheet 2 is cut by the biasing force of the first biasing member 51 in the retracting direction, and after the engagement between the intermittent gear portion 36 of the drive unit 30 and the intermittent tooth portion 27 provided in the movable blade holder 23 that holds the movable blade 21 is released, the movable blade 21 can be moved in the retracting direction, and the movable blade 21 can be quickly returned to the standby position. Thus, after the sheet 2 is cut, sheet feeding can be immediately performed, and thus the occurrence of sheet jam can be reduced, and the cutter device 20 capable of high-speed cutting can be provided.

Further, the printer 1 according to the present exemplary embodiment includes the cutter device 20 capable of quickly returning the movable blade 21 to the standby position after the sheet 2 is cut, and can thus perform high-speed printing. Further, the fixed blade 22 is disposed closer to the sheet holding portion 7 side than the movable blade 21, and thus the transport path 16 of the sheet 2 can be provided between the drive unit 30 that drives the movable blade 21 and the sheet holding portion 7, which makes it possible to reduce the size of the printer 1.

Note that the present disclosure is not limited to the exemplary embodiment described above. For example, the cutter device 20 of the present disclosure is not limited to the printer 1 in the overview illustrated in FIG. 1, and is applicable to printers of various configurations.

The first biasing member 51 that biases the movable blade 21 in the retracting direction and the second biasing member 52 that biases the movable blade 21 in the cutting direction can also be configured by an elastic member (e.g., a synthetic rubber) other than a tension spring.

In the exemplary embodiment described above, the so-called cutter device 20 in which two blades intersect each other is illustrated, but the present disclosure is not limited to this and is applicable to a cutter device of various configurations in which the movable blade 21 reciprocates to cut the sheet 2.

The contents derived from the exemplary embodiments described above will be described below.

A cutter device includes a fixed blade, a movable blade configured to be able to reciprocate horizontally with respect to a blade surface of the fixed blade, a drive means configured to cause the movable blade to reciprocate, and a first biasing member configured to bias the movable blade. Provided that a direction in which the movable blade approaches the fixed blade is a cutting direction in the direction of the reciprocating movement, a direction in which the movable blade is separated from the fixed blade is a retracting direction in the direction of the reciprocating movement, and a direction in which the movable blade is pressed against the fixed blade is an engaging direction in a direction perpendicular to the blade surface of the movable blade, the first biasing member biases the movable blade in the retracting direction and the engaging direction. The drive means includes an engagement portion that drives the movable blade in the cutting direction by resisting biasing force of the first biasing member. When the engagement between the movable blade and the engagement portion is released, the movable blade retracts in the retracting direction by the biasing force of the first biasing member.

According to this configuration, when the engagement between the movable blade and the engagement portion is released, the movable blade is configured to retract in the retracting direction by the biasing force of the first biasing member. Thus, the biasing force of the first biasing member acts in the retracting direction of the movable blade, and after cutting, the movable blade can be quickly returned to the standby position (open position) and a cutting speed of the cutter device can be increased.

In the cutter device described above, provided that an angle at which the biasing direction of the first biasing member and the retracting direction intersect each other is an angle A, the angle A may be in a range of greater than or equal to 10° and less than or equal to 80° in a position where the movable blade contacts the fixed blade, and the angle A may be in a range of greater than or equal to 60° and less than or equal to 100° in a position where the movable blade does not contact the fixed blade.

According to this configuration, the angle A is in a range of greater than or equal to 10° and less than or equal to 80° in the position where the movable blade contacts the fixed blade, the movable blade can be biased in the retracting direction and the engaging direction. Thus, after cutting, the movable blade can be quickly returned to the standby position, and stable cutting can also be performed by increasing the pressing force between the movable blade and the fixed blade during cutting.

Furthermore, in the position where the movable blade does not contact the fixed blade, the angle A is in a range of greater than or equal to 60° and less than or equal to 100°, and thus an attachment space of the first biasing member can be reduced.

In the cutter device described above, the first biasing member may be a tension spring that is hung on a hook portion provided at a center, in a width direction, of the movable blade.

According to this configuration, the first biasing member is the tension spring, and can thus easily be obtained. Further, since the first biasing member is hung on the hook portion provided at the center in the width direction of the movable blade, biasing force can be stably applied to the center of the movable blade.

In the cutter device described above, the hook portion may be provided with a resin member.

According to this configuration, the resin member is provided on the hook portion on which the first biasing member is hung, and thus wear of the first biasing member and the hook portion can be reduced.

In the cutter device described above, in cutting the sheet by the reciprocating movement of the movable blade, a spring length of the tension spring may be maximum in a final position of the movable blade where the cutting ends.

According to this configuration, the spring length of the tension spring is maximum in the final position of the movable blade where the cutting of the sheet ends, and thus the biasing force of the tension spring can be maximized in the final position of the moving blade where the cutting of the sheet ends, and the movable blade can be quickly returned to a standby position.

In the cutter device described above, the cutter device may further include a second biasing member configured to provide biasing force to the movable blade in a direction that cancels the biasing force of the first biasing member.

According to this configuration, the cutter device further includes the second biasing member configured to provide the biasing force to the movable blade in the direction that cancels the biasing force of the first biasing member. Accordingly, when the movable blade retracts in the retracting direction by the biasing force of the first biasing member, the biasing force of the first biasing member configured to bias the movable blade in the retracting direction is weakened, and thus a striking sound can be reduced.

The printer is a printer including the cutter device described above. The printer includes a device main body including a printing mechanism portion and a sheet holding portion that holds a sheet, and a lid portion that is pivotally provided on the device main body to cover the sheet. The cutter device is disposed in the device main body. The fixed blade is disposed closer to the sheet holding portion side than the movable blade.

According to this configuration, after cutting, the movable blade is configured to retract in the retracting direction by the biasing force of the first biasing member. Thus, as a printer includes the cutter device capable of quickly returning the movable blade to the standby position (open position) after cutting, the printer with a high printing speed can be provided.

Further, the fixed blade is disposed closer to the sheet holding portion side than the movable blade, and thus a transport path of a sheet can be provided between the drive means configured to drive the movable blade and the sheet holding portion, which makes it possible to reduce the size of the printer.

What is claimed is:

1. A printer, comprising:

a first blade configured to be movable between a standby position and a cutting position, and configured to cut a sheet at the cutting position;

a second blade configured to contact the first blade located at the cutting position;

a drive mechanism configured to drive the first blade; and a first elastic member configured to pull the first blade located at the cutting position, wherein when the first blade is located at the cutting position, the first elastic member pulls the first blade in a direction in which the first blade moves from the cutting position to the standby position, and pulls the first blade in a direction in which the first blade approaches the second blade.

2. The printer according to claim 1, wherein the drive mechanism further includes an engagement portion, the first blade moves from the standby position to the cutting position by engaging with the engagement portion, and when the first blade is disengaged from the engagement portion after moving to the cutting position, the first blade moves from the cutting position to the standby position.

3. The printer according to claim 1, wherein the first elastic member is a tension spring that is hung on a hook portion provided at a center, in a width direction, of the movable blade.

4. The printer according to claim 3, wherein the hook portion includes a resin member.

5. The printer according to claim 3, wherein a spring length of the tension spring is maximum when the first blade is located at the cutting position.

6. The printer according to claim 1, further comprising a second elastic member configured to pull the first blade in a direction in which the first blade moves to the cutting position when the first blade is located at the standby position.

7. The printer according to claim 1, further comprising:

a device main body including a printing mechanism portion and a sheet holding portion configured to hold the sheet; and a lid portion pivotally provided on the device main body to cover the sheet, wherein the second blade is provided closer to the sheet holding portion side than the first blade is.

8. A cutter device, comprising:

a first blade configured to be movable between a standby position and a cutting position, and configured to cut a sheet at the cutting position;

a second blade configured to contact the first blade located at the cutting position;

a drive mechanism configured to drive the first blade; and a first elastic member configured to pull the first blade located at the cutting position, wherein when the first blade is located at the cutting position, the first elastic member pulls the first blade in a direction in which the first blade moves from the cutting position to the standby position, and pulls the first blade in a direction in which the first blade approaches the second blade.

* * * * *